United States Patent [19]

Gibbs

[11] Patent Number: 5,044,079

[45] Date of Patent: Sep. 3, 1991

[54] FOLDING KNIFE WITH OPEN LOCK FEATURE HAVING IMPROVED SPRING ELEMENT

[75] Inventor: Philip W. Gibbs, Camillus, N.Y.

[73] Assignee: Camillus Cutlery Co., Camillus, N.Y.

[21] Appl. No.: 519,895

[22] Filed: May 7, 1990

[51] Int. Cl.[5] ..... B26B 03/06

[52] U.S. Cl. ..... 30/160; 30/161; 30/158; 30/159

[58] Field of Search ..... 30/161, 152, 155, 158, 30/159, 160, 164

[56] References Cited

U.S. PATENT DOCUMENTS

| | | | |
|---|---|---|---|
| 4,573,268 | 3/1986 | Call | 30/160 |
| 4,805,303 | 2/1990 | Gibbs | 30/161 |
| 4,947,552 | 8/1990 | Barnes | 30/161 |

*Primary Examiner*—Mark Rosenbaum
*Assistant Examiner*—Allan M. Schrock
*Attorney, Agent, or Firm*—Katherine McGuire

[57] ABSTRACT

A knife having at least one blade or other implement foldable about a pivot axis at one end of the handle. A separate lock lever is associated with each blade or implement and has an end portion engaging a notch in the blade adjacent the pivot point to prevent movement of the blade away from the open position until the lock is manually released. The lock levers are mounted for limited pivotal movement at an intermediate position and urged toward engagement of the one end portion with the blade notch when the blade is moved to its open or erected position by respective beam springs. The improved beam springs are mounted upon linings in a position laterally spaced from their respective lock levers. The beam spring end opposite the mounted end is curved and extends laterally through a hole in its associated lining and contacts its associated lock lever. The lock levers are released from the blade notches by pressing upon portions of the lock levers arranged in transverse grooves which are longitudinally offset along the back of the knife at the end opposite the end at which the blades are pivotally mounted.

18 Claims, 2 Drawing Sheets

FOLDING KNIFE WITH OPEN LOCK FEATURE HAVING IMPROVED SPRING ELEMENT

BACKGROUND OF THE INVENTION

This invention relates to folding knives having locking means automatically movable to prevent movement of one or more blades away from the fully open position until the lock is manually released and, more particularly, to a novel and uniquely configured spring element and placement thereof within such a knife assembly.

Reference is made to U.S. Pat. No. 4,805,303 of the present inventor entitled "Folding Knife with Lock Open Feature" having an issue date of Feb. 21, 1989. The knife assembly described therein incorporates a beam spring associated with a lock lever and blade for urging the lock lever to engage a notch in the blade tang to keep the blade from moving in a direction away from the fully open position. Manual pressure exerted upon the exposed, opposite end of the lock lever releases the blade to allow it to fold into a space within the handle in the manner shown and described. The beam springs are positioned directly beneath and in the same plane of their associated lock levers within the knife assembly which dictates that the overall housing dimensions of the knife defined by the outer cover pieces and bolsters, be significantly larger than the dimensions of the blades which are foldable therein.

When the blades of the knife construction of the aforementioned patent are moved into their folded or closed position, the edge of their blade tangs come into contact with the lock levers to stop further rotation of the blades and therefore prevent contact of the sharpened edges of the blades with the beam springs. However, manual pressure exerted upon the folded blade, which occurs when grasping the knife housing in the intended manner for using an unfolded blade, causes the folded blade to pivot further and "bottom out" against its associated beam spring resulting in dulling of the sharpened edge.

It is a principal object of the present invention to provide a folding knife having a lock open feature in which the outer perimeter length and height dimensions of the knife housing closely approximate the corresponding length and height dimensions of the blades or other such implements foldable therein.

It is a further object of the present invention to provide a folding knife having a lock open feature which will not permit the sharpened edges of the blades to contact any element contained within the housing of the knife assembly when the blades are in their folded or closed position.

It is another object of the present invention to provide a folding knife having a lock open feature in which the position and configuration of the beam spring used to urge the locking mechanism into engagement with the notch in an associated blade tang permits the size of the blades to approximate more closely the size of the knife handle.

A still further object is to provide a novel beam spring construction for incorporation in an improved folding knife assembly wherein one or more of such beam springs may be appropriately positioned and configured for employment in knives having only one blade or a plurality of blades pivoted either at the same or at opposite ends of the handle.

Other objects will in part be obvious and in part appear hereinafter.

SUMMARY OF THE INVENTION

The knife of the present invention includes one or more folding blades or other implements which, of course, need not be cutting implements in the usual sense, but will be termed "blades" for convenience. It will be understood that as used herein the term encompasses all implements which may be pivotally mounted on a handle for movement with respect thereto between folded and erected positions. It is also noted that the following discussion and drawings are directed to a two blade knife, however; the scope of this invention covers a single blade knife assembly as well as a multi-blade knife assembly as set forth in the claims appended hereto.

A squared notch is formed in the tang of each blade adjacent the opening through which the pivot pin passes. A lock lever associated with each blade includes a squared end portion shaped and positioned for engagement with the notch in the associated blade when the latter is in its fully erected or open position, preventing movement of the blade about its pivotal mounting until the lock lever end portion is removed from the notch. The levers are mounted for limited pivotal movement about an axis intermediate the ends of the handle and parallel to the pivot axis of the blades.

The lock levers are urged toward movement in a direction engaging the squared end thereof with the blade notch by an associated beam spring. The beam springs are anchored at one end to a respective one of the usual handle linings which have outlines closely approximating the outline of the two external cover pieces. The springs are anchored to the surface of the lining facing its associated cover piece, the cover pieces each including a relief in which the anchored portion of the beam spring may lie such that the lining and associated cover piece are in tight engagement with each other. The linings each include a hole through which a second, curved end of its respective beam spring may transversely extend and pass through to bear against the underside of its associated lock lever. Spacer pieces are provided adjacent the ends of the lock levers opposite the squared end and are positioned in longitudinal alignment therewith. Another metal piece, commonly termed a center scale, is positioned between the pair of lock levers and spacer pieces in the two blade knife assembly embodiment described and shown herein.

Each of the handle cover pieces and linings, as well as the center scale, is provided with a pair of curved grooves or scallops in one endge. The grooves in the several elements are laterally aligned when the knife is fully assembled and are longitudinally spaced but preferably closely adjacent at the end of the knife opposite that at which the blades are pivotally mounted. One of the two lock levers and the opposite one of the two spacer pieces each have a single groove aligned with respective ones of the two grooves in the other member.

The lock levers may be released from locking engagement with the respective blades by manually pressing on the portion of the associated lock lever which extends into the groove on one side of the knife, thereby pivoting the lock lever against the bias of the associated beam spring. Individual manipulation of the laterally spaced lock levers is facilitated by positioning the manually engageable portions thereof in grooves which are longitudinally spaced at one end of the knife handle.

DETAILED DESCRIPTION

Figure 1:
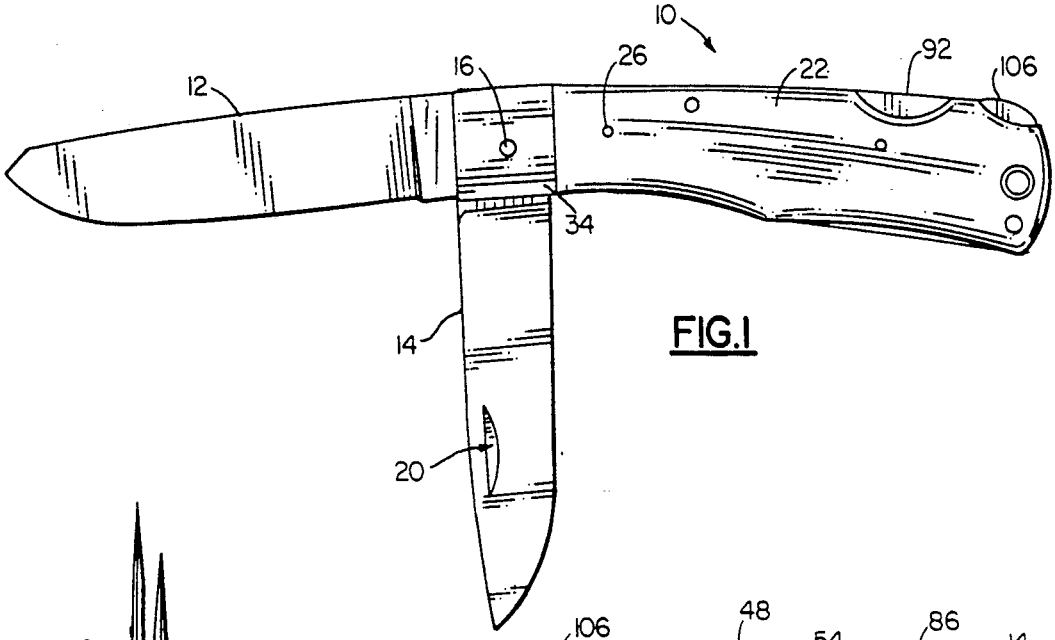
FIG. 1 is a side elevational view of the knife of the invention in a two blade embodiment, shown with one blade fully open and the other partly open.

Referring now to the drawings, there is seen in FIG. 1 a two blade embodiment of the knife of the invention having a handle portion denoted generally by the reference numeral 10 which includes various elements to be described below. A pair of blades 12 and 14 are pivotally mounted for movement between open and folded positions at one end of the handle 10 by pivot pin 16 extending transversly through the tang portions of the blades 12 and 14. As seen in both FIGS. 1 and 4, blades 12 and 14 include grooves 18 and 20, respectively, on opposite surfaces thereof such that grooves 18 and 20 are accessible for selectively moving blade 12 or 14 in the usual manner from its folded position to its extended position, usually with a thumbnail.

Figure 4:
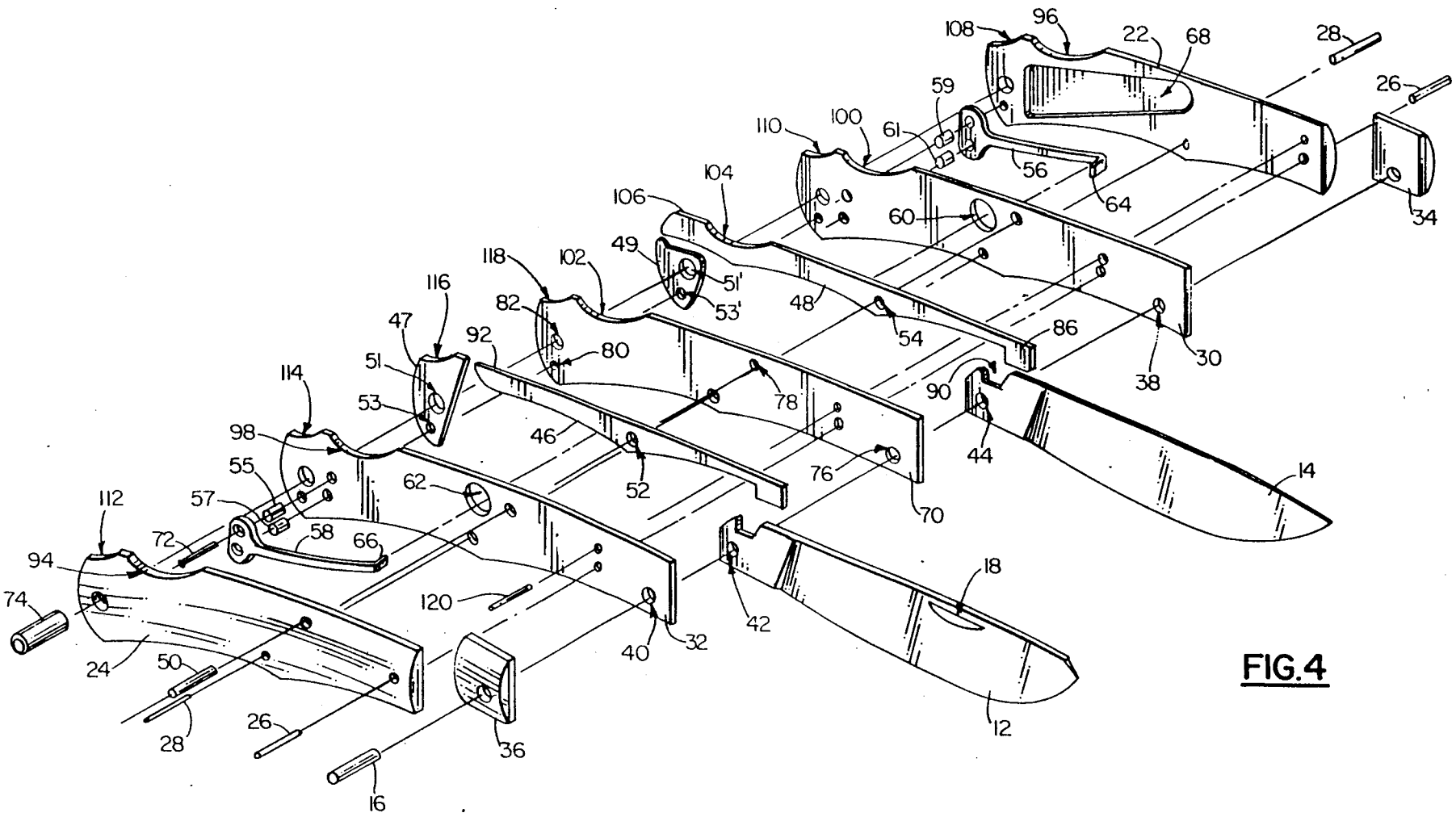
FIG. 4 is an exploded perspective view.

Handle 10 includes outer cover pieces 22 and 24, preferably of Delrin or other suitable plastic, attached by pins 26 and 28 to linings 30 and 32, respectively, preferably of brass. Handle 10 further includes bolsters 34 and 36, also mounted upon linings 30 and 32, respectively, by pivot pin 16 which passes entirely through handle 10, in complementary relation to cover pieces 22 and 24 so that cover pieces and bolsters completely cover the linings. Pivot pin 16 extends through openings 38 and 40 in linings 30 and 32, respectively, and through openings 42 and 44 in the tang portions of blades 12 and 14, respectively (FIG. 4).

A pair of lock levers 46 and 48 are mounted parallel to one another in handle 10 for limited pivotal movement about middle pin 50 which passes through openings 52 and 54 in levers 46 and 48, respectively. Spacers 47 and 49 are mounted to handle 10 at the end opposite to which blades 12 and 14 are mounted and are positioned in longitudinal alignment with lock levers 46 and 48, respectively, and include holes 51 and 53 and 51', 53' for passage of butt pin 72 and tube 74 therethrough, respectively. Beam springs 56 and 58 are mounted on the surfaces of linings 30 and 32 which lie adjacent covers 22 and 24 by pins 55, 57, 59 and 61 respectively. Linings 30 and 32 include holes 60 and 62, respectively, through which laterally extended curved end portions 64 and 66 of beam springs 56 and 58 pass to bear against portions of lock levers 46 and 58, respectively, on one side of the pivotal mountings thereof, in the fully assembled condition of handle 10. Covers 22 and 24 include reliefs or recesses on their inside surfaces to accommodate the mounted portion of springs 56 and 58 on the surface of linings 30 and 32 adjacent covers 22 and 24 such that covers and linings are in tight engagement, one such relief 68 shown in cover piece 22 in FIG. 4.

Also included in handle 10 is center scale 70, an appropriately configured brass strip which separates the tang portions of blades 12 and 14 in the usual manner of folding knife construction. Center scale 70 also separates lock levers 46 and 48 and the laterally extended and curved end portions 64 and 66 of associated beam springs 56 and 58. Pivot pin 16, middle pin 50, butt pin 72 and tube 74 pass through openings 76, 78, 80 and 82, respectively, in center scale 70. It should be readily apparent that in a single blade knife embodiment, the pieces to the right of lock lever 46 would not be present, except for the cover piece 22 and associated bolster 34 and pins.

Lock levers 46 and 48 are formed with squared end portions 84 and 86, respectively. Squared notches 88 and 90 are formed in the tang portions of blades 12 and 14, respectively, adjacent pivot pin openings 42 and 44. Lock levers 46 and 48 are urged toward rotation about their respective pivotal mountings by beam springs 56 and 58 in a direction moving end portions 84 and 86 into engagement with the tang portions of blades 12 and 14, respectively. Thus, the lock levers serve the function of the usual back springs provided in folding knives to act cooperatively with the blade tangs, resiliently urging the blades into both the fully closed or folded and fully open positions.

Figure 6:
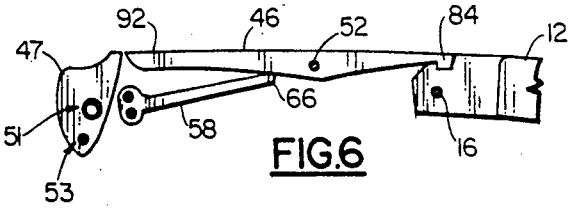
FIGS. 6 and 6*a* are fragmentary, elevational views, in section on the line 6—6 in FIG. 3, showing other elements in first and second positons.
Figure 6A:
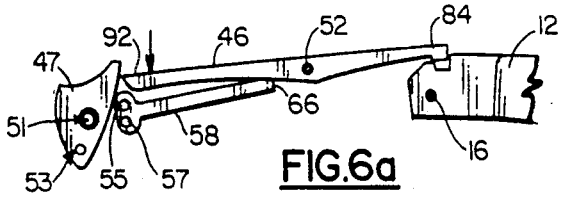

When blade 12 is moved to its fully open position, squared portion 84 of lock lever 46 enters notch 88, thereby preventing further movement of blade 12 in either direction until squared end portion 84 is removed from notch 88. This may be accomplished by manually pressing on portion 92 of lock lever 46, forcing it to rotate a short distance against the biasing force of beam spring 58. It will be noted that portion 92 of lock lever 46 is positioned in a groove extending across the back of handle 10 and formed by laterally aligned grooves 94 and 96 in cover pieces 24 and 22, respectively, grooves 98 and 100 in linings 32 and 30, respectively, and grooves 102 and 104 in center scale 70 and lock lever 48, respectively. Movement of lock lever 46 and its associated beam spring 58 between locking and unlocking positions is illustrated in FIGS. 6 and 6*a*, respectively.

Figure 5:
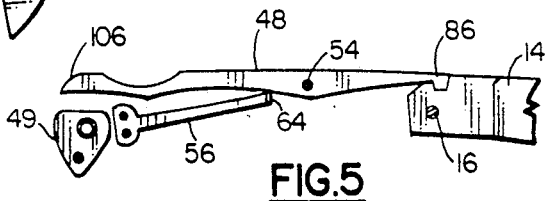
FIGS. 5 and 5*a* are fragmentary, elevational views, in section on the line 5—5 of FIG. 3, showing certain elements in first and second positions of movement.
Figure 2:
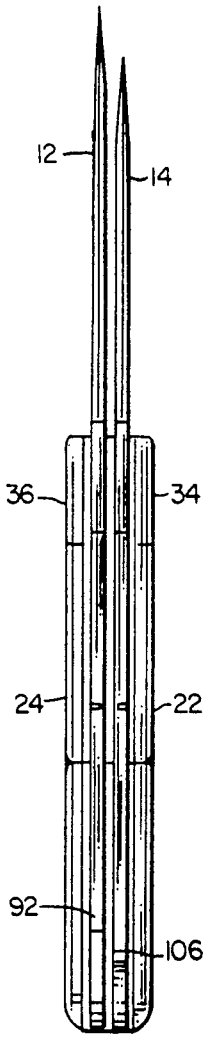
FIG. 2 is a front elevational view of the knife of FIG. 1 with both blades fully open.
Figure 3:
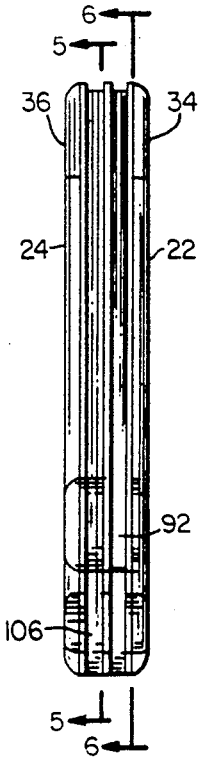
FIG. 3 is a rear elevational view with the blades fully closed.
Figure 5A:
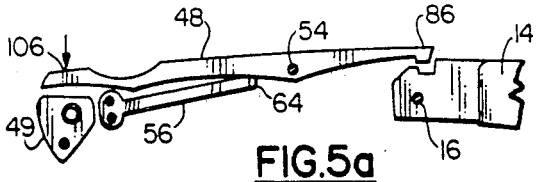

Blade 14 is locked in its fully open position by engagement of squared end portion 86 of lock lever 48 in notch 90. Unlocking is accomplished by manually pressing on portion 106 of lock lever 48 to produce rotation against the biasing force of beam spring 56. The elements are shown in the locking and unlocking positions in FIGS. 5 and 5*a*, respectively. Portion 106 is also arranged in a groove extending laterally across the back of handle 10. The continuous groove is formed by laterally aligned grooves 108 and 110 in cover piece 22 and lining 30, respectively, on one side of lock lever 48 by laterally aligned grooves 112, 114, 116 and 118 in cover piece 24, lining 32, spacer 47, and center scale 70, respectively, on the other side of lock lever 48.

Finally, a stop pin 120 is provided which laterally extends through holes in linings 30 and 32 and center scale 70 such that it is positioned along the internal edges of lock levers 46 and 48 adjacent the blade tangs such that when blades 12 and 14 are moved to their folded, closed position, the tang portions of blades 12 and 14 contact stop pin 120 thereby preventing further rotation of blades 12 and 14 about pivot pin 16. Stop pin 120 thus effectively prevents the sharpened edges of blades 12 and 14 from "bottoming out" or contacting internal elements of the knife assembly which would have an undesirable dulling action on the blades over extended periods of use.

From the foregoing, it may be seen that the knife of the present invention is an unobvious improvement over the '303 patent of the present inventor in that the new configuration and placement of the beam spring within the knife assembly creates a folding knife having a lock open feature in which the length of the handle assembly may be shortened to more closely approximate the corresponding lengths of the blades foldable therein. The direct mounting of the beam spring on the lining allows the beam spring to be much smaller in length than, and yet still be as effective as, the beam spring of the '303 patent.

The present configuration and placement of the beam spring also allows spacers 47 and 49, which were an integral part of the beam springs of the '303 patent, to be smaller in size. Beam springs 56 and 58 are presently placed within the knife assembly in a plane spaced from the plane of lock levers 46 and 48 and blades 12 and 14, thereby allowing blades 12 and 14 to rotate a further distance about pivot pin 16 without "bottoming out" than was possible with the knife assembly of the '303 patent. This permits a handle assembly 10 which is smaller in height as measured between the two longest edges of the handle cover pieces 22 and 24 adjacent pins 28 and 50. This height more closely approximates the corresponding, respective height of blades 12 and 14 than the knife assembly of the '303 patent.

There is thus provided a folding knife having a lock open feature which has a handle assembly having length and height dimensions closely approximating the corresponding length and height dimensions of the blades foldable therein whereby the weight and bulk of the knife assembly is reduced.

What is claimed is:

1. In a folding knife having a handle portion and at least one blade having a tang portion pivotally mounted for movement about an axis at one end of said handle for movement of said blade between closed and open positions, a locking and release mechanism for releasably securing said blade in the fully open position, said mechanism comprising, in combination:

(a) a lock lever mounted in said handle for limited pivotal movement with respect thereto about a pivot axis parallel to said blade tang pivot axis, and having a first end portion configured for engagement in a notch in the tang portion of said blade which is aligned with said lock lever first end portion when said blade is in its fully open position, wherein said lock lever and said blade are in substantially co-planar longitudinally aligned relation; and (b) a beam spring mounted in said handle, and having a first end portion anchored to said handle in a plane laterally spaced from the plane in which said lock lever and said blade lie, and a second end portion laterally extending from said first end portion, said second end portion contacting said lock lever at a position on the opposite side of said lock lever pivot axis from said lock lever first end portion and exerting a biasing force urging said lock lever toward rotation in a direction moving said lock lever first end portion into engagement with said notch in said blade tang portion, said spring second end portion being flexibly movable against said biasing force by manual pressure exerted on a predetermined portion of said lock lever.

2. The invention according to claim 1 and further comprising a pair of external cover pieces mounted to said handle and wherein said beam spring first end portion is anchored to the surface of an associated lining of substantially the same outline as said cover pieces, said lining positioned between said lock lever and one of said cover pieces, said surface lying adjacent said one of said cover pieces, said lining including a hole through which said laterally extending second portion of said beam spring passes to contact said lock lever.

3. The invention according to claim 1 and further comprising means along the back of said handle defining said predetermined portion of said lock lever.

4. The invention according to claim 3 wherein said predetermined portion of said lock lever is substantially at the end of said lock lever opposite said first end portion thereof and wherein said defining means comprises a groove extending laterally across the end of said handle opposite the end to which said blade is pivotally mounted, said predetermined portion of said lock lever positioned in said groove.

5. The invention according to claim 4 and further comprising a spacer piece mounted to said handle, said spacer piece positioned adjacent the end of said lock lever opposite said first end portion thereof and in longitudinal alignment therewith.

6. The invention according to claim 5 wherein said first end portions of said lock lever, and said notch in said blade tang portion are substantially square.

7. The invention according to claim 1 and further comprising a stop pin laterally extending through said handle adjacent said blade tang whereby pivotal rotation of said blade is limited when moved to said closed position by contact of said blade tang with said stop pin.

8. A folding knife comprising:

(a) at least one blade having a tang portion with a notch therein;

(b) a handle portion including at least one lining externally covered by a cover piece of substantially the same outline as said lining;

(c) a pivot pin extending through said tang portion to mount said blade adjacent one end of said handle portion for pivotal movement with respect thereto between open and closed positions;

(d) at least one lock lever mounted in parallel relation between said cover pieces at an intermediate position between said one end and a second, opposite end portion of said handle for limited, pivotal movement between first and second positions, wherein a first end portion of said lock lever is respectively in and out of engagement with said notch in said blade tang portion when said blade is in its open and closed positions;

(e) at least one beam spring having an anchored end and a free end wherein said anchored end of said beam spring is in a position laterally spaced from said lock lever;

(f) said free end of said beam spring laterally extending from said anchored end and contacting said lock lever at a position thereon on the opposite side of the pivotal mounting of said lock lever from said first end portion urging said lock lever toward said first position, said lock lever being movable to said second position by manual pressure exerted on a second end portion thereof; and (g) at least one groove extending laterally across said handle portion adjacent the end opposite said one end of said handle, said second end portion of said lock lever being disposed in said groove wherein it is accessible for exertion of said manual pressure.

9. The invention according to claim 8 wherein said anchored end of said beam spring is mounted to the surface of said lining adjacent said cover piece and wherein said lining includes a hole through which said free end of said beam spring laterally passes to contact said lock lever.

10. The invention according to claim 8 and further comprising a stop pin laterally extending through said handle portion adjacent said blade tangs whereby pivotal rotation of said blades is limited when moved to said closed positions by contact of said blade tangs with said stop pin.

11. The invention according to claim 8 and further comprising a center scale mounted in said handle portion between said at least one lock lever, beam spring, lining, cover piece and blade tang portion associated therewith on one side of said center scale, and a second lock lever, second beam spring, second lining and second blade tang portion associated therewith, on the second, opposite side of said center scale.

12. The invention according to claim 11 wherein said at least one groove extends through a portion of said second lock lever.

13. The invention according to claim 11 wherein said pivot pin extends through both of said cover pieces, linings and blade tang portions, and said center scale.

14. The invention according to claim 13 wherein each of said cover pieces includes a metal part arranged at said one end of said handle portion and through which said pivot pin extends.

15. The invention according to claim 11 wherein said at least one groove comprises laterally aligned grooves in both of said cover pieces and linings, said center scale and said second lock lever.

16. The invention according to claim 11 and further comprising a second groove extending laterally across said handle portion at a position longitudinally spaced from said at least one groove and adjacent said handle second end, a respective second end portion of said second lock lever being disposed in said second groove wherein it is accessible for individual exertion of said manual pressure.

17. The invention according to claim 16 and further comprising first and second spacer pieces mounted to the end of said handle opposite said one end, said first and second spacer pieces positioned in longitudinal alignment with said first and second lock levers, respectively and wherein said second groove comprises laterally aligned grooves in both of said cover pieces and linings, said center scale and said first spacer piece.

18. The invention according to claim 17 wherein said second groove extends through a portion of said first spacer piece.

* * * * *